United States Patent [19]

Reitzel

[11] Patent Number: 4,813,079

[45] Date of Patent: Mar. 21, 1989

[54] QUILTED WEIGHT PAD FOR SPORTS GLOVES AND METHOD

[76] Inventor: Jimmie R. Reitzel, Rt. 7, Box 660-P, Charlotte, N.C. 28213

[21] Appl. No.: 50,565

[22] Filed: May 18, 1987

[51] Int. Cl.[4] ..... A41D 19/00

[52] U.S. Cl. ..... 2/160; 2/161 A; 2/167; 128/77; 128/165

[58] Field of Search ..... 2/20, 159, 160, 161 R, 2/161 A, 167, 243 R; 128/77, 165; 273/54 B, 166

[56] References Cited

U.S. PATENT DOCUMENTS

| | | | |
|---|---|---|---|
| 889,397 | 6/1908 | O'Shaughnessy | 2/159 |
| 2,154,197 | 4/1939 | Callaway | 2/159 |
| 3,108,285 | 10/1963 | Turnidge et al. | 2/161 R |
| 3,258,782 | 7/1966 | Turnidge et al. | 2/161 R |
| 4,247,097 | 1/1981 | Schwartz | 2/160 X |
| 4,684,123 | 8/1987 | Fabry | 2/161 A X |
| 4,702,234 | 10/1987 | Huntjens | 128/77 |

FOREIGN PATENT DOCUMENTS

| | | | |
|---|---|---|---|
| 97224 | 4/1923 | Austria | 2/161 R |
| 378262 | 7/1964 | Switzerland | 2/159 |

*Primary Examiner*—Wm. Carter Reynolds
*Attorney, Agent, or Firm*—Clifton Ted Hunt

[57] ABSTRACT

An amount of lead wool selected according to weight is shaped and covered to form a flexible weight pad for use in a sports glove to fit against the back of a person's hand. The pad is quilted with rows of stitches to compress the lead wool in the area of the stitches and define individual weight sections between the rows of stitches. Each weight section is of a desired weight depending on the spacing of adjacent rows of stitches.

2 Claims, 2 Drawing Sheets

QUILTED WEIGHT PAD FOR SPORTS GLOVES AND METHOD

FIELD OF THE INVENTION

This invention relates to weighted sports gloves and is useful, for example, in golf, tennis, and bowling.

BACKGROUND OF THE INVENTION

Weighted sports gloves have long been known for use in sports such as golf, tennis, bowling, and the like.

U.S. Pat. No. 2,187,987 issued Jan. 23, 1940 to John C. Sherrick teaches that a weight applied to the leading hand of a golfer serves the double purpose of directing the swing and of adding to the kinetic energy of the club. Sherrick concentrates the weight at the lower edge of the leading hand for the purpose of returning that hand by centrifugal force to its original ball addressing position at the moment of impact. Sherrick uses individual lead weights each weighing about an ounce in a pocket on the back edge of the glove opposite the thumb.

U.S. Pat. No. 3,124,806 issued Mar. 17, 1964 to Roderick D. Campbell, et al. shows in FIG. 4 a plurality of tubular longitudinally extending compartments 19, each containing a selected amount of weight. Campbell teaches that the use of either a single monolithic weight or a plurality of individual spaced weights on the back of a golf glove strenghens the muscles of the user and assists in the lengthening of drives and the elimination of "hooks" and "slices".

U.S. Pat. No. 2,154,197 issued Apr. 11, 1939 to Harold J. Calloway and U.S. Pat. No. 2,831,196 issued Apr. 22, 1958 to Walter Scheiber each teach the use of stays extending across the wrist between the hand and forearm to guide the golfer's hand.

U.S. Pat. No. 3,108,285 issued Oct. 29, 1963 to Cletus P. Turnidge, et al. teaches the use of powdered or otherwise finely particulated lead to be used as a weapon in the palm of a policeman's glove. U.S. Pat. No. 4,247,097 issued Jan. 27, 1981 to Leonard Schwatz discloses the use of fine lead shot as variable weight in an aerobic exercise glove.

SUMMARY OF THE INVENTION

The quilted weight pad of applicant's invention comprises a flexible weight with a fabric cover divided by rows of quilting stitches into elongated weight sections. In the illustrated embodiment, the rows of quilting stitches diverge from the end of the pad nearest the user's wrist in use and are arranged to corespond with the location of the tendons on the back of the user's hand. It is intended that, in the illustrated embodiment, the rows of quilting stitches be correlated with the tendons and function as braces.

The flexible weight is preferably a selected amount of lead wool. An ounce and a half has been found to be a satisfactory weight for one golf player, but other golfers and other sports may prefer a different weight. The amount of weight is not an essential feature of the invention.

The quilting stitches extend through and compress the flexible lead wool weight, defining elongated weight sections to be positioned between the tendons in use and stabilize the braces defined by the quilting stitches. The quilted weight pad is durable, comfortable to the user, and stays in place when sewn inside the back of a sports glove. It is described for use with a golf glove, but is useful with other gloves when additional weight is desired.

It is an object of the invention to provide a weighted pad for use with a sports glove, the pad comprising a continuous flexible weight divided into elongated weight sections which are oriented to be parallel, in use, with the tendons on the back of a users hand.

It is a further object of the invention to provide a weighted pad of the type described wherein the flexible weight is lead wool.

It is another object of this invention to provide a weighted pad of the type described wherein the elongated weight sections are defined by rows of quilting stitches diverging from the end of the pad nearest the users wrist to overlie and brace the tendons on a user's hand.

DETAILED DESCRIPTION OF THE INVENTION

Figure 1:
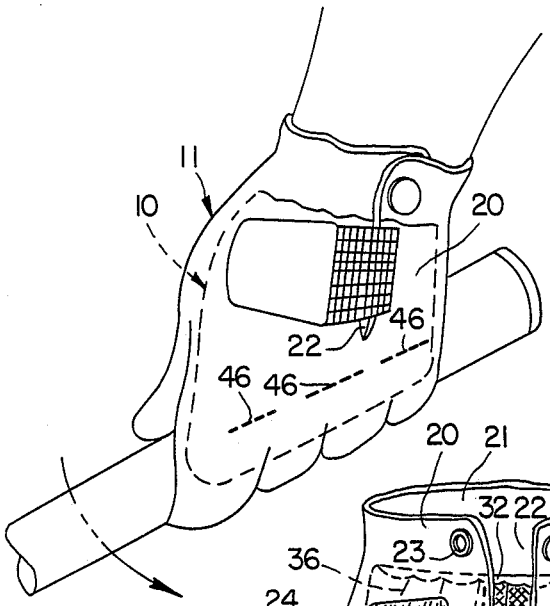
FIG. 1 is a perspective view showing the weighted pad in dotted lines positioned for use inside the back panel of a golf glove.

Referring more specifically to FIGS. 1 through 6 of the drawings, a weight pad is generally indicated at 10. The pad 10 is intended to be sewn inside the back of a glove, such as generally indicated at 11.

The structure of the glove is not a part of the invention and the weighted pad may be used with any glove to provide additional weight when desired. The glove may or may not have finger pockets such as indicated at 12, 13, 14, 15, and 16. The illustrated glove has a back panel 20 and a front panel 21 with the back panel 20 having a V-shaped opening 22 closable by either or both snap fasteners 23 and a hook and eye fastener 24 of the type sold under the trademark VELCRO.

The weight pad 10 comprises a cover 30 formed from cotton fabric or any other desired material and a flexible weight comprising a selected quantity of lead or copper wool 31. Although lead has the advantage of weight, availability and price, other metals may be used, and reference is made to lead in the specification and claims with the understanding that it includes all metals from which "wool" of the type described can be made.

The lead wool 31 is a commercially available product which is extruded in a molten state resulting in filaments which are cut to a desired length of an inch or more and averaging about 1/16 of an inch in diameter. The filaments of lead are deliberately entangled in a homogeneous mass of a selected size. The mass of entangled lead fibers is flexible and may be readily pulled apart to provide a smaller mass of a desired weight which is easily shaped to fit the back of a person's hand, or into any other configuration.

In the illustrated embodiment, the cover 30 is folded on itself as at 32 to define an inner panel 33 beneath the lead wool 10 and an outer panel 34 overlying the lead wool. The three open sides of the top and bottom layers 33 and 34 of the cover 30 are secured together about the lead wool by perimeter stitching indicated at 35.

The weight pad is 10 is completed by rows of quilting stitches 36, 37, 38, 39, and 40 diverging from the folded edge 32 of the pad 10 and penetrating both sides of the cover 30 and the lead wool 31 as they extend to the perimeter stitching 35. The quilting stitches compress the lead wool in the immediate area of the stitches (FIG. 5), defining individually weighted tubulalr sections 41, 42, 43, 44, and 45.

Figure 2:
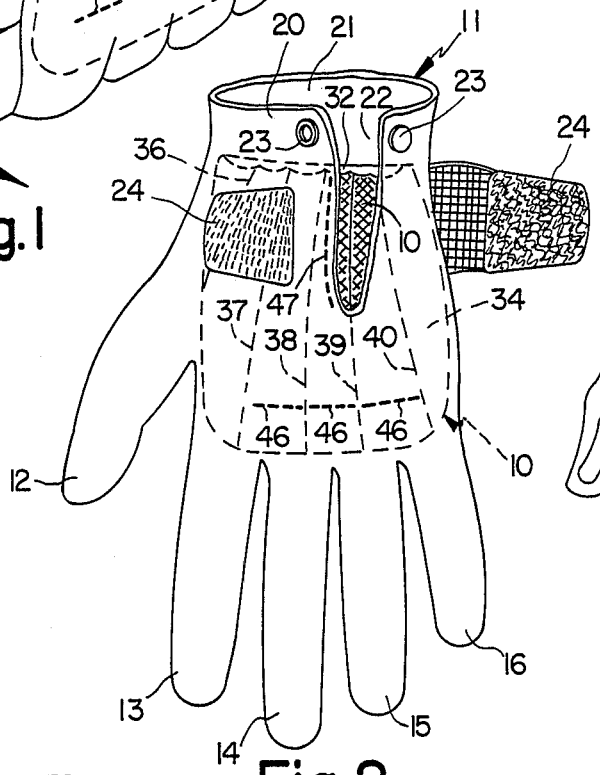
FIG. 2 is a plan view looking at the back of the glove shown in FIG. 1 removed from the hand and illustrating the rows of quilting stitches in the weight pad.
Figure 3:
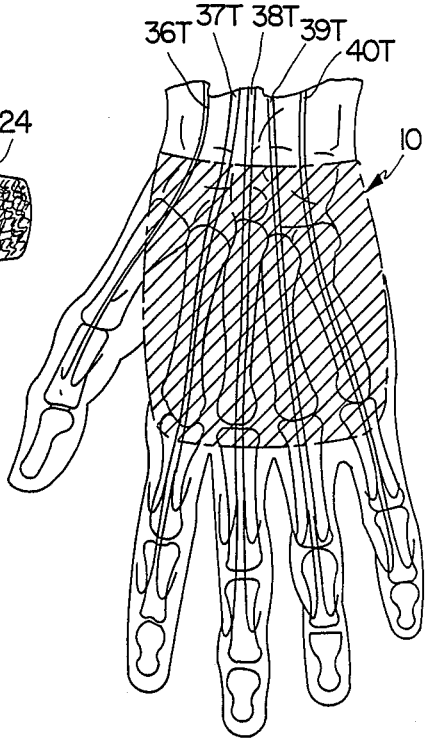
FIG. 3 is a plan view showing the weight pad in phantom lines overlying the back of a person's hand and illustrating by comparison with FIG. 2 the correlation of the rows of quilting stitches with the tendons of the hand.
Figure 4:
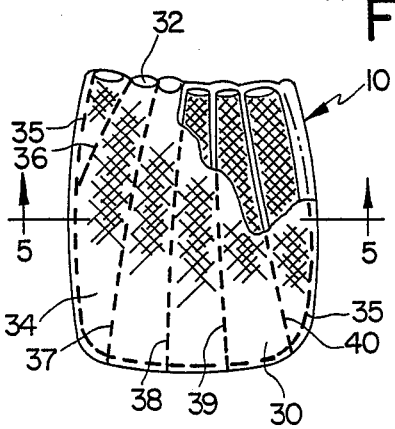
FIG. 4 is a plan view, with parts broken away, of the quilted weight pad removed from the glove.

Referring to FIG. 3, the weight pad 10 is shown in overlying relation to the back of a person's hand for the purpose of demonstrating by comparison with the orientation of the rows of quilting stitches in FIG. 2, that the rows of quilting stitches 36, 37, 38, 39, and 40 are arranged in the pad to overlie respective tendons 36T, 37T, 38T, 39T, and 40T. The rows of quilting stitches 36-40 serve, with reenforcement from the adjoining lead wool, as braces for their respective tendons.

The quilted weight pad 10 is fastened inside the back panel 20 of the glove 11 by transverse stitches 46 and longitudinal stitches 47 along one edge of the V-shaped opening 22.

Figure 5:
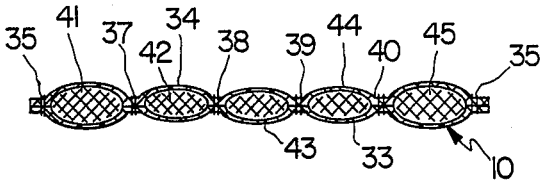
FIG. 5 is a sectional view taken substantially along the line 5—5 in FIG. 4.
Figure 6:
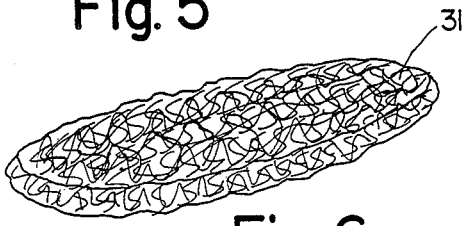
FIG. 6 is a perspective view of the lead wool removed from the pad.

Referring to FIG. 5, it will be observed that the mass of lead wool and the consequent weight of the endmost tubular weight sections 41 and 45 are approximately the same as each other but both of the end sections 41 and 45 are larger and heavier than the intervening tubular weight sections 42, 43, and 44 defined by the rows of quilting stitches 37, 38, 39, and 40. It is desirable for some players to have additional weight at the marginal edges of the glove while playing golf while other golfers may prefer a different distribution of weight in the pad. The weight of each individual weight section can be selected as desired.

MODIFIED FORM

Figure 8:
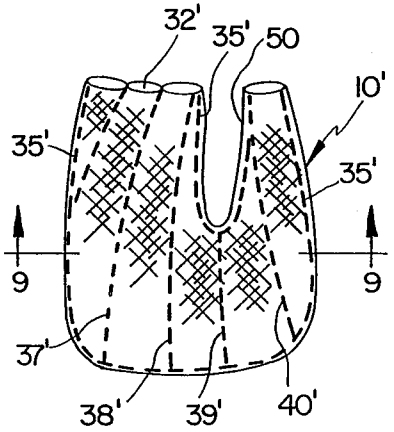
FIG. 8 is a plan view of the modified weight pad removed from the glove of FIG. 7.
Figure 9:
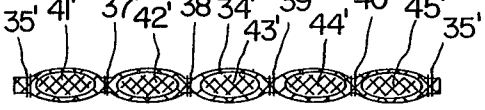
FIG. 9 is a sectional view taken substantially along the line 9—9 in FIG. 8.
Figure 7:
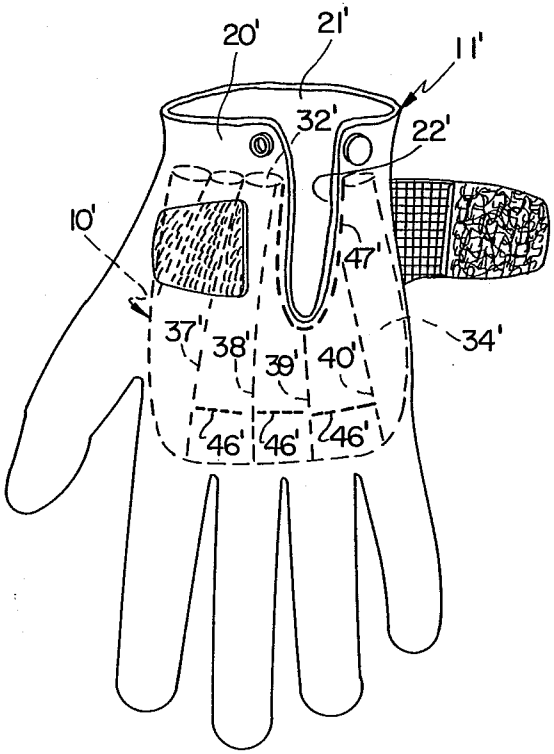
FIG. 7 is a plan view of the glove shown in FIG. 1 with a modified weight pad shown in dotted lines.

FIGS. 7, 8, and 9 illustrate a modified form wherein like parts are identified by the same reference character with the prime notation added. A further description of these parts is deemed unnecessary.

The configuration of the weight pad $10^1$ of the modified form differs from that of the first described weight pad 10 by having a V-shaped notch 50 extending inwardly from the folded end $32^1$ to complement or coincide with the V-shaped opening $22^1$ in the glove $11^1$. The edges of the V-shaped notch 50 are closed by additional perimeter stitching $35^1$. The pad $10^1$ is fastened inside the back $20^1$ of the glove $11^1$ with transverse stitches $46^1$ and with stitches $47^1$ along the edges of the V-shaped opening $22^1$.

As shown in FIG. 9, the weighted section $41^1$, $42^1$, $43^1$, $44^1$, and $45^1$ defined by the quilting stitches $37^1$, $38^1$, $39^1$, and $40^1$ are all of the same size so that the weight is evenly distributed across the back of the hand.

METHOD OF MANUFACTURE

The weight pad heretofore described may be made for the sports glove 11 by providing a quantity of the lead wool 31, selecting a desired amount of lead wool to provide a desired weight for the glove 11, and shaping the lead wool to fit against the back of a person's hand. The fabric cover 30 is wrapped around the lead wool to form the weight pad 10 either before or after the lead wool is shaped to fit against the back of a person's hand.

The pad is completed by rows of quilting stitches 36, 37, 38, 39, and 40 extending in diverging relation to each other to compress the pad in the area of the stitches and define individual weight sections between the rows of stitches. The amount of lead wool in each section and the consequent weight of each section can be varied as desired to satisfy the user's preference for the distribution of weight on the back of the glove.

The completed weight pad 10 is positioned and fastened with suitable stitching on the back of the glove 11 with the diverging rows of stitches correlating with the tendons on the back of a user's hand, so that, in use, the rows of quilting stitches 36–40 serve, with reenforcement from the adjoining lead wool, as braces for their respective tendons.

There is thus provided a flexible weight pad enabling a selected distribution of weight across the back of a user's hand, and wherein the weight pad includes quilting stitches overlying and bracing the tendons of the user's hand and stabilized by the weight of the lead wool at the sides of each tendon.

Although specific terms have been used in describing the invention, they have been used in a generic sense only and not for the purpose of limitation. It is recognized that the illustrated embodiments are not the only way of making or using the invention, and it is intended to obtain patent protection on the invention as defined in the following claims, considered in light of the specification and drawings, and in light of the prior art.

I claim:

1. A weight pad for use in a sports glove, said pad comprising a mass of lead wool of a selected weight shaped to fit against the back of a person's hand, a fabric cover extending about the lead wool, quilting stitches extending in diverging rows from the wrist end of the glove to compress the lead wool and define a weight pad with weight sections between the rows of stitches, said rows of quilting stitches being arranged to correlate with the tendons in the back of a person's hand when the sports glove is positioned on a person's hand, and means for attaching the weight pad to the back of a sports glove.

2. A method of making a weight pad for a sports glove, said method comprising the steps of:

(a) providing a predetermined amount of lead wool;
(b) shaping the lead wool to fit against the back of a person's hand;
(c) providing a cover about the lead wool to define a weight pad;
(d) quilting the pad with rows to stitches to compress the pad in the area of the stitches and define weight sections between the rows of stitches;
(e) forming the rows of stitches in diverging relation to each other;
(f) providing a sports glove; and
(g) fastening the weight pad to the back of the glove with the diverging rows of stitches positioned to correlate with the tendons on the back of a wearer's hand.

* * * * *